US008319656B2

(12) United States Patent
Clark et al.

(10) Patent No.: US 8,319,656 B2
(45) Date of Patent: Nov. 27, 2012

(54) METHOD, SYSTEM, AND APPARATUS OF DOWNHOLE TIME INTERLACED COMMUNICATIONS

(75) Inventors: Bruce J. Clark, Newmachar (GB); Matthias Volkert, Aberdeen (GB); Edwin J. Coutts, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 469 days.

(21) Appl. No.: 12/648,886

(22) Filed: Dec. 29, 2009

(65) Prior Publication Data

US 2010/0164748 A1 Jul. 1, 2010

Related U.S. Application Data

(60) Provisional application No. 61/141,319, filed on Dec. 30, 2008.

(51) Int. Cl.
*G01V 3/00* (2006.01)

(52) U.S. Cl. ..... 340/853.2; 340/854.9

(58) Field of Classification Search ..... 340/854.9, 340/853.2; 370/441; 324/351
See application file for complete search history.

(56) References Cited

U.S. PATENT DOCUMENTS 4,355,310 A * 10/1982 Belaigues et al. ..... 340/853.2
4,451,790 A * 5/1984 Bravenec ..... 324/351
5,387,907 A * 2/1995 Gardner et al. ..... 340/854.9
7,061,932 B2 * 6/2006 Gardner et al. ..... 370/441

* cited by examiner

*Primary Examiner* — Jean B Jeanglaude
(74) *Attorney, Agent, or Firm* — Bracewell & Giuliani LLP

(57) ABSTRACT

A method, system, and apparatus of downhole time interlaced communications are provided. The method includes setting command intervals for first and second communications systems associated with downhole tools. Each command interval is a delay value between consecutive commands greater than an actual command duration to define periods of communications inactivity. The command interval of the second communications system is slightly greater than that of the first to overcome any drift. The method includes detecting communications interference between the systems and applying temporarily a positive command interval shift to the first communications system and a negative command interval shift to the second communications system so that a duration of a resynchronization is minimized. An apparatus for downhole time interlaced communications includes a configurable communications interface card to communicate with surface equipment, having a command interval register and a command interval shift register that is applied temporarily when communications interference is detected.

17 Claims, 4 Drawing Sheets

SIMPLE TIMING DIAGRAM

TIMING DIAGRAM SHOWING COMMUNICATIONS INTERFERENCE

TIMING DIAGRAM SHOWING A COMMAND INTERVAL SHIFT ON BOTH INTERFACE CARDS

| PRIORITY | CYCLES OF THE TASK SCHEDULER | | | |
|---|---|---|---|---|
| 6 | 6 | 12 | 18 | 24 |
| 8 | 8 | 16 | 24 | |

| PRIORITY | CYCLES OF THE TASK SCHEDULER | | | | | | |
|---|---|---|---|---|---|---|---|
| 5 | 5 | 10 | 15 | 20 | 25 | 30 | 35 |
| 7 | 7 | 14 | 21 | 28 | 35 | | |

METHOD, SYSTEM, AND APPARATUS OF DOWNHOLE TIME INTERLACED COMMUNICATIONS

1. RELATED APPLICATIONS

This application claims priority to and the benefit of U.S. Provisional Patent Application No. 61/141,319, filed Dec. 30, 2008, titled "Downhole Time Interfaced Communications," incorporated herein by reference in its entirety.

BACKGROUND OF THE INVENTION

1. Field of the Invention

The present invention relates in general to communications with downhole instruments in a well bore and, in particular, to an improved method, system, and apparatus for time interlaced communications.

2. Description of Related Art

In the subterranean drilling and completion industries, including with regard to oil and gas exploration and retrieval, it is known for surface equipment to communicate with downhole equipment located in a well bore, including sensors, controllers, and tools. Such downhole communication is useful, for example, for permanent monitoring of downhole equipment and measurement systems, including static and dynamic pressure, temperature, artificial lift parameters, and other information as understood by those skilled in the art. Such information is useful to determine production performance, calculate reserves, and input into reservoir simulations. Such information can also be used to determine reservoir characteristics and to control and optimize production rates.

Downhole communications can occur, for example, over a cable from the surface to downhole equipment located in a well bore, including a dedicated communications cable and also including a communications over a power cable. Downhole communications can be one-way or, more commonly, two-way, i.e., both from and to the surface. Due to the benefits of downhole communications, it is known for multiple systems to attempt to coexist.

SUMMARY OF THE INVENTION

Applicants recognize a problem in systems with two downhole interface cards connected to two sets of downhole tools in a well bore communicating over a two-core cable to devices at the surface. Applicants further recognize that the source of the problem is interference caused by the two cores of the cable being in close proximity of each other down the length of the cable. Accordingly, example embodiments of the present invention provide methods, systems, and apparatuses for downhole time interlaced communications to improve communication performance in a downhole, multi-tool environment.

A method of downhole time interlaced communications according to an example of an embodiment of the present invention can include setting a first delay value between consecutive downhole commands to define a first command interval for a first communications system associated with a cable and a first downhole tool. The first command interval can be greater than an actual command duration to thereby define periods of communications inactivity and to thereby allow communications with minimal interference for a second communications system associated with a second downhole tool. The method can include setting a second delay value between consecutive downhole commands defining a second command interval for the second communications system associated with the cable and a second downhole tool. The second command interval can be slightly greater than the first command interval to thereby overcome any effects of drift. The method can include detecting communications interference. The method can include applying temporarily a positive command interval shift to the first communications system and a negative command interval shift to the second communications system responsive to the detected communications interference so that a duration of a resynchronization is minimized.

A system of downhole time interlaced communications according to an example of an embodiment of the present invention can include a first communications system associated with a cable and a first downhole tool. The system can include a second communications system associated with the cable and a second downhole tool. The system can also include a first delay value between consecutive downhole commands defining a first command interval for the first communications system. The first command interval can be greater than an actual command duration to thereby define periods of communications inactivity to thereby allow communications with minimal interference for the second communications system. The system can include a second delay value between consecutive downhole commands defining a second command interval for the second communications system. The second command interval can be slightly greater than the first command interval to thereby overcome any effects of drift. The system can include a resynchronization of the first and second command intervals, including a positive correction to be applied to the first command interval defining a positive command interval shift and a negative correction to be applied to the second command interval defining a negative command interval shift, responsive to a detected communications interference so that a duration of the resynchronization is minimized.

An apparatus for downhole time interlaced communications according to an example of an embodiment of the present invention can include a downhole configurable communications interface card to communicate with surface equipment having various parameters. The parameters can include a reset register to enable time interlaced communications. The parameters can also include a command interval register to set the interval between the initiations of consecutive downhole commands to thereby define periods of communications inactivity to thereby allow communications with minimal interference for another communications system. The parameters can also include a command interval shift register that is applied temporarily when communications interference is detected. The parameters can also include a shift count register to maintain a count of the number of occurrences where communications interference has been detected and the command interval shift has been applied. The parameters can also include a downhole communications timeout register to set the delay before a communications controller at the surface is put back into reset in the event that no response from the downhole tool is received.

BRIEF DESCRIPTION OF THE DRAWINGS

So that the manner in which the features and advantages of the invention, as well as others which will become apparent, may be understood in more detail, a more particular description of the invention briefly summarized above may be had by reference to the embodiments thereof which are illustrated in the appended drawings, which form a part of this specification. It is to be noted, however, that the drawings illustrate only various embodiments of the invention and are therefore not to be considered limiting of the invention's scope as it may include other effective embodiments as well.

DETAILED DESCRIPTION

The present invention will now be described more fully hereinafter with reference to the accompanying drawings in which embodiments of the invention are shown. This invention may, however, be embodied in many different forms and should not be construed as limited to the illustrated embodiments set forth herein; rather, these embodiments are provided so that this disclosure will be thorough and complete, and will fully convey the scope of the invention to those skilled in the art. Like numbers refer to like elements throughout.

Applicants recognize a problem in systems with two downhole interface cards connected to two sets of downhole tools in a well bore communicating over a two-core cable to devices at the surface. Applicants further recognize that the source of the problem is interference caused by the two cores of the cable being in close proximity of each other down the length of the cable. Accordingly, example embodiments provide methods, systems, and apparatuses for downhole time interlaced communications to improve communication performance in a downhole, multi-tool environment.

Applicants recognize that communications interference can occur when a command is transmitted on a downhole line, and the command signal is coupled onto a second downhole line, affecting the second system. Similarly, command signals transmitted on the second downhole line can affect the first system. The coupling of signals across downhole lines can cause communications errors. Moreover, standard communications interface card operation has continuous downhole communications, where subsequent commands are initiated immediately following the completion of the previous command. Continuous downhole communications maximize the likelihood that coupling will result in interference.

Accordingly, example embodiments provide for a time interlaced communications mode. Time interlaced communications introduce a delay between consecutive downhole commands. This delay results in a period of communications suppression that allows successful communications, without communications interference, on the second downhole system. The time between consecutive commands is identified as a command interval.

Figure 1:
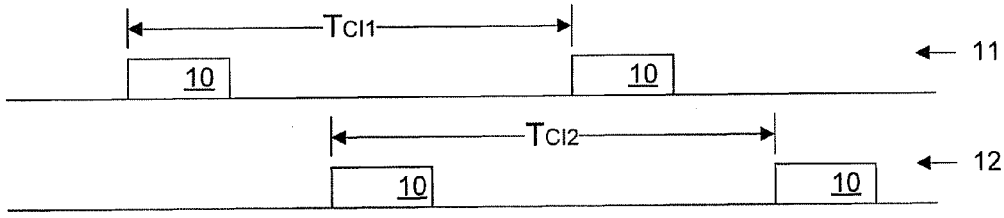
FIG. 1 is a simple timing diagram for two downhole communications systems in accordance with an example embodiment of the present invention.

With reference now to FIG. 1, example embodiments provide a first command interval $T_{C11}$ for a first communications system 11. The command interval is the delay value between consecutive commands. Commands are shown at 10. Example embodiments also include a second command interval $T_{C12}$ for a second communications system 12. As shown, the delay value between commands for $T_{C12}$ is very similar to that of $T_{C11}$. That is, $T_{C12} \approx T_{C11}$. Having similar values for the command intervals can maximize the time that communications continue to operate without interference, as described below.

Applicants recognize that differences in environmental conditions and component tolerances of the interface cards result in variation of timing for each interface card. Applicants further recognize that this variation can cause communications to drift (in time) so that eventually the communications on the two systems can overlap, creating interference.

Figure 2:
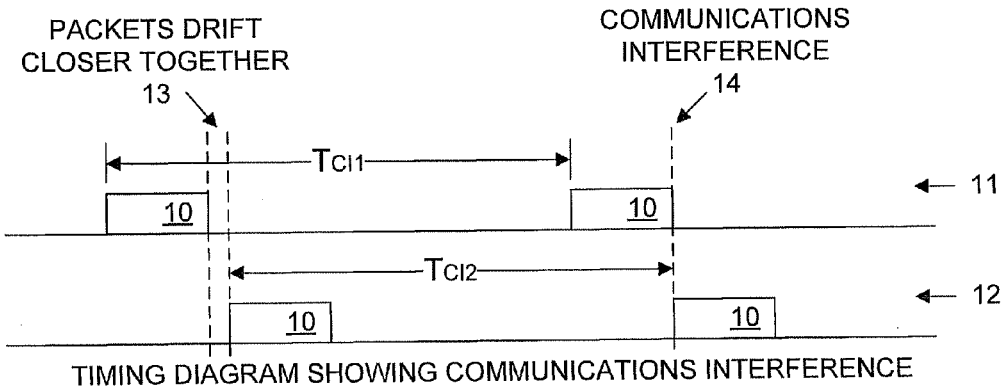
FIG. 2 is a timing diagram showing communications interference between two downhole communications systems in accordance with an example embodiment of the present invention.

With reference now to FIG. 2, example embodiments provide a time interlaced communications mode, wherein the commands drift over time with respect to each other. Commands are shown at 10. As shown at 13, the initial commands are quite close, and, as shown at 14, the subsequent commands have drifted a little more and have overlapped resulting in communications interference in one or both systems.

When communications interference 14 occurs, downhole data retrieval on one, or both systems, will be unsuccessful. Example embodiments provide that to avoid further interference, the interface card, or cards, that were unsuccessful, will briefly change the interval between commands. The first interface card of the first communications system 11 adds an additional delay, while the second communications system 12 reduces the delay. The change in command interval is known as a command interval shift, and applying the command interval shift causes a resynchronization.

Figure 3:
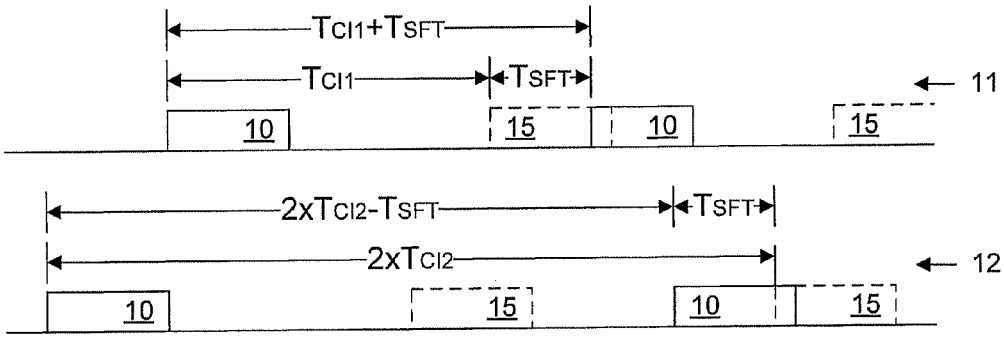
FIG. 3 is a timing diagram showing a command interval shift on two interface cards of downhole communications systems in accordance with an example embodiment of the present invention.

With reference now to FIG. 3, example embodiments provide a shift ($T_{SFT}$) for the interface cards of both communication systems. A positive shift is added to $T_{C11}$, creating a longer delay in the first communication system 11. A negative shift is added to $T_{C12}$, which as shown is applied to the second command interval, rather than the first in the second communication system 12. Commands are shown at 10. As shown at 15, the commands, or packets, depicted with a dotted line indicate where the packets would be in time if the shifts were not applied.

As mentioned previously, Applicants recognize that as a result of manufacturing and environmental variation, no two interface cards will have exactly the same timing. Therefore, with two communications systems, one interface card will run faster than the other, causing the communications to drift in time until eventually the communications overlap, resulting in communications interference. Example embodiments provide that on detection of this interference the communication systems will shift and resynchronize. Depending on which direction the packet is shifted (i.e., a positive or negative time), however, more than one shift may be required. This can increase the synchronization time, resulting in longer periods between consecutive updates. Applicants further recognize that the shortest resynchronization time will occur where the faster interface card has a positive command interval shift and the slower interface card has a negative command interval shift. Unfortunately, timing variations of the interface cards are unknown. It is therefore not generally possible to determine the "faster" interface card due to drift and to set the command interval shift settings accordingly.

Example embodiments provide, however, for forcing one card to be faster than the other so the cards can be setup to have the minimum resynchronization delay. In an exemplary embodiment, a command interval difference of 1 ms is sufficient to overcome the drift effects and is the smallest allowable difference to maintain a minimal number of resynchronizations.

For example, using a nominal command interval of 5 seconds, a first card may be set to 5.000 seconds, and a second card set to 5.001 seconds. By assigning a positive command interval shift to the interface card with the shortest command interval, e.g., the first card, and a negative command interval shift to the other interface card, e.g., the second card, the duration of the resynchronization is minimized. For example, if a command interval shift of 1053 ms is to be used, the card set to 5.000 seconds can have a command interval shift of +1053 ms, and the card set to 5.001 seconds can have a command interval shift of −1053 ms.

Example embodiments provide, for example, for a delay allowing for response data from the downhole tool defining a downhole communications timeout. The downhole communications timeout is first initiated when the command has completed transmission and is retriggered each time a response byte, from the downhole tool, is received. When a valid response is received, the timeout is cancelled. The standard timeout used in many continuous communications deployments is typically 5 seconds to allow for significant retries by the downhole communications controller, as understood by those skilled in the art. Retries may be required for installations where there is significant electrical noise. In embodiments using time interlaced communications mode where third party noise is not expected, the downhole communications timeout can be reduced to potentially improve performance.

The communications device located at the surface is active until the downhole response is complete or the timeout expires. While the communications device located at the surface is active, there is the potential for communications interference to occur. That is, a long timeout may adversely affect the performance of the system, where the timeout is used to await a downhole response. To minimize any effect, this timeout can be set to a similar duration to the expected command response duration so the communications device located at the surface is not active any longer than necessary in normal operation.

Example embodiments provide configurable interface cards used with downhole time interlaced communications. The interface cards can include various configurable parameters, also known as registers, wherein the values in the registers implement the example embodiments. In an exemplary embodiment, the parameters are implemented as MODBUS registers, as understood by those skilled in the art. As understood by those skilled in the art, the MODBUS protocol is a messaging structure originally developed by Modicon in 1979, used to establish master-slave/client-server communication between intelligent devices. The MODBUS protocol is a de facto standard for a network protocol in the industrial manufacturing environment, used typically to transfer discrete/analog I/O and register data between control devices. It's a lingua franca or common denominator between different manufacturers.

Exemplary embodiments can provide, for example, for a reset register. A reset register can be used to enable and disable the capability to hold the downhole communications controller in reset when the card is not communicating to ensure that the downhole communications controller does not inadvertently interfere with the communications process when not explicitly communicating.

Exemplary embodiments can provide, for example, for a command interval register. This register can be a configurable register, used to set the interval between the initiations of consecutive downhole commands. By setting the interval to be longer than the actual command duration, periods of communications inactivity can be defined. These periods of communications inactivity allow communications on other downhole systems, without communications interference.

In an exemplary embodiment, the command interval register can only be set to positive values and is defined in milliseconds. In an exemplary embodiment, a command rate of about 5 times the command duration can be used, providing active and inactive periods of equal duration when looking at both systems. For example, in the case of a 1 second Read Latest Data command being used, the command rate would be 5 seconds.

Exemplary embodiments can provide, for example, for a command interval shift register. This register can be used to set the command interval shift that is applied temporarily when communications interference is detected. In an exemplary embodiment, the register can have positive or negative values and is defined in milliseconds.

Exemplary embodiments can provide, for example, for a shift count register. This read-only register maintains a count of the number of occurrences where communications interference has been detected and the command interval shift has been applied. This is a diagnostic value that can be useful to assess the performance of the system.

Exemplary embodiments can provide, for example, for a downhole communications timeout register. This register can be used to set the delay before the communications controller located at the surface is put back into reset in the event that no response from the downhole tool is received. In an exemplary embodiment, this register can only be set to positive values and is defined in milliseconds.

Example embodiments further provide that selecting a command interval involves a compromise between an update rate and a resynchronization interval. An update rate is the frequency at which an interface card obtains updates of the downhole data. In most applications, it is desirable to have a high update rate (i.e., the time between updates of the downhole data is short), as the downhole data will be updated more frequently. The update rate is primarily affected by the command interval, since the command interval determines the time between consecutive downhole commands. It is to be noted that the interval between updates will exceed the command interval where multiple commands are required to retrieve data (e.g., where there are multiple downhole tools sharing a single interface card). A resynchronization interval is the period between consecutive resynchronizations that result from the detection of downhole communications interference. Each resynchronization initiates a command interval shift that will interrupt the data retrieval process. In most applications, it is desirable to have a long resynchronization interval so that the data retrieval process will be interrupted less often.

Example embodiments provide that a short command interval can increase the update rate, but also reduces the resynchronization interval. Likewise, a long command interval increases the resynchronization interval, but decreases the update rate. Inevitably, the command interval must be selected as a compromise between the update rate and the resynchronization interval in accordance with an example embodiment.

Figures 4, 5:
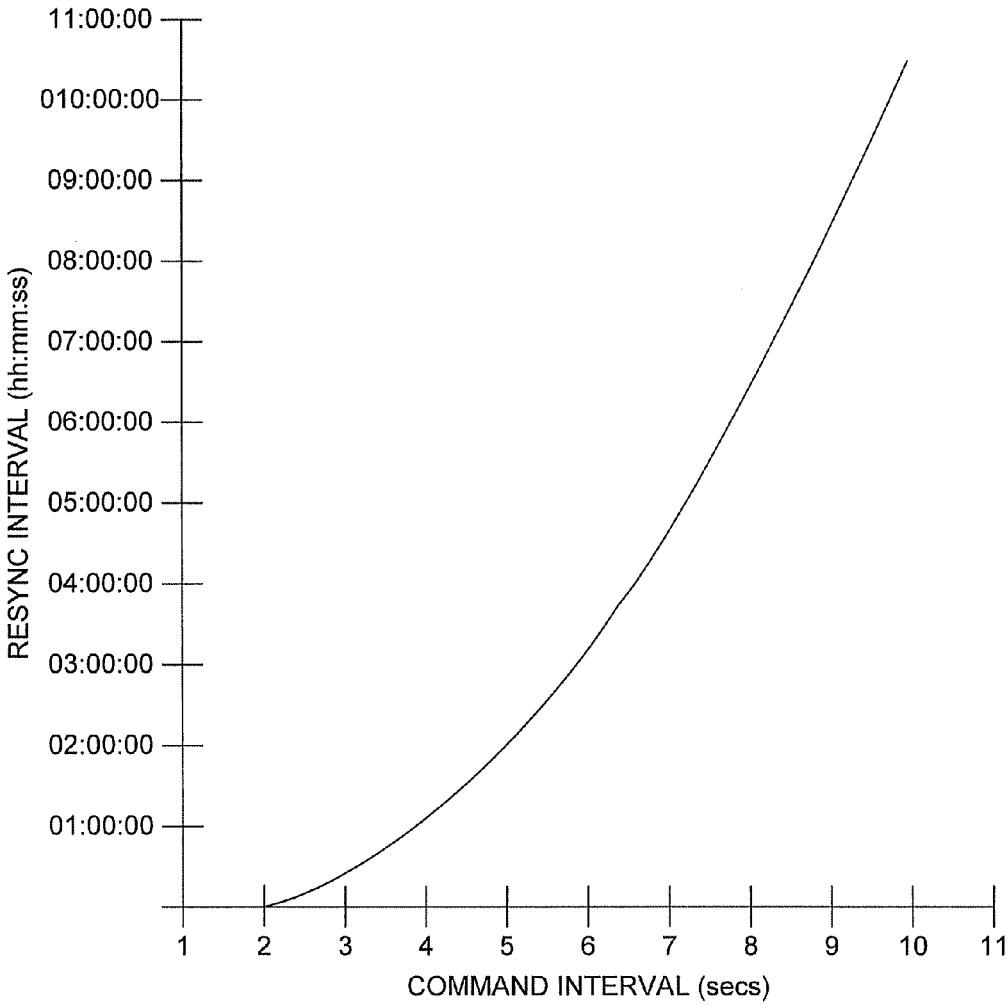
FIG. 4 is a chart showing a relationship between a command interval and a resynchronization interval in a system in accordance with an example embodiment of the present invention.
FIG. 5 is a chart comparing even and prime number priorities in accordance with a task scheduler of an example embodiment of the present invention.
Figure 6:
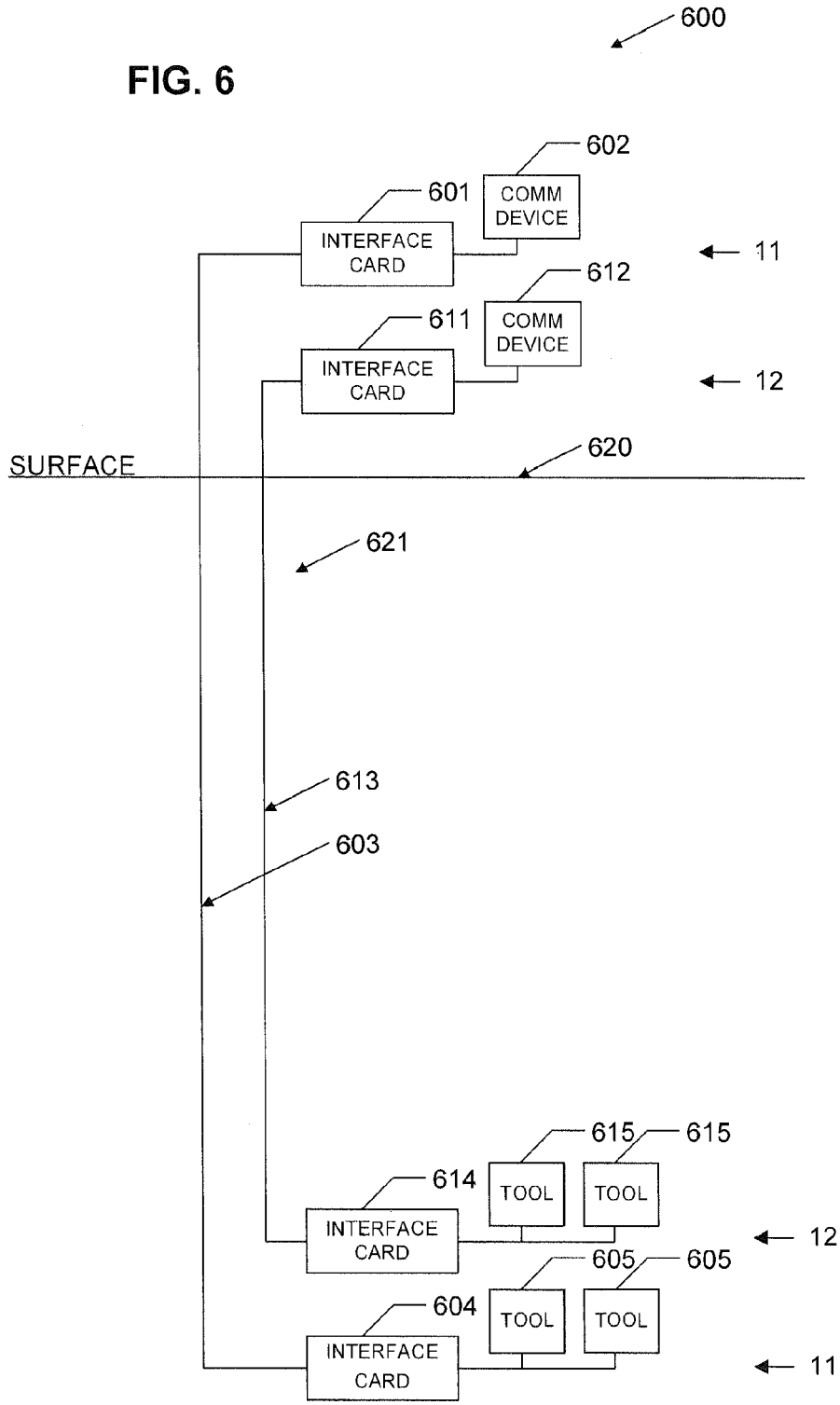
FIG. 6 is a schematic diagram of a system of downhole time interlaced communications in accordance with an example embodiment of the present invention.

With reference now to FIG. 4, a graph of command interval vs. resynchronization interval is provided in accordance with an example of an embodiment of the present invention, such as, for example, that shown in FIG. 6. As will be described in more detail later, the exemplary embodiment illustrated includes two example communications systems with each system having a downhole interface card with two tools per card. The graph shown in FIG. 4 is based on calculations where two cards are operating at the limit of their tolerances to illustrate the principle.

Example embodiments further provide assigning a priority to each downhole command of a plurality of downhole commands to determine the frequency of execution, with special attention paid to diagnostic commands. According to an example of an embodiment, each downhole command can be assigned a priority with a task scheduler to determine the frequency of execution. A priority of 1 can indicate that the downhole command will be performed as often as possible by the task scheduler. A downhole command with a priority of 2 can indicate that the command will be performed half as frequently. Commands with the same priority will be performed at a similar time, causing a delay for commands set to be performed more frequently.

Diagnostic information is useful for investigating issues with the downhole system, as understood by those skilled in the art. Historical diagnostic information can be particularly useful where data communications with the downhole tool has subsequently failed. As a result, it is useful to routinely use diagnostic commands during normal operation. Too-frequent diagnostics commands, however, can consume valuable bandwidth that could otherwise be used for data. Example embodiments include assigning the priorities for the diagnostic commands with larger values than standard data retrieval commands so that the diagnostic commands will be performed less frequently than standard data retrieval commands. In addition, example embodiments also include that the priority for each diagnostic command be unique so they are not all executed at the same time, thereby improving the update rate. Example embodiments further include assigning prime numbers to a priority value of diagnostic commands to reduce the likelihood that multiple diagnostics will be executed at the same time.

With reference now to FIG. 5, a comparison is made between even and prime numbers used as priority values for downhole commands. FIG. 5 shows that prime numbers are less coincident, since the coincidence is a multiple of the priority values, rather than a multiple of the factors of the priority values. Example embodiments further provide that the priority of the diagnostic commands be high enough as not to adversely affect the update rate, but regular enough that the data is still relevant. In an exemplary embodiment, the priority can be chosen such that the update rate of diagnostic data is approximately 15 minutes.

In addition, example embodiments provide that the time interlaced communications mode suppresses the command interval shifts in the event that a downhole tool becomes unresponsive. In normal operation of time interlaced communications, the absence of a response from a downhole tool would be associated with communications interference and a command interval shift would be initiated. If the absence of response has another cause (e.g., as the result of a downhole tool, connector, or cable issue), however, the command interval shift is not necessary. Further, the shift (in time) of communications for the downhole systems can introduce communications interference in a system that was otherwise operating correctly. Accordingly, various embodiments of the present invention include automatically suppressing the command interval shifts when there is repeatedly no response to the downhole command.

With reference now to FIG. 6, an example of an embodiment of the present invention includes a system 600 of downhole time interlaced communications. The system 600 includes first and second downhole communications systems 11, 12. The first system 11 includes a first surface communications interface card 601 associated with a first communications device 602 located at the surface 620, a first downhole communications interface card 604 associated with one or more first downhole tools 605, and a cable core 603 connecting the surface and downhole interface cards. Similarly, the second system 12 includes a second surface communications interface card 611 associated with a second communications device 612 located at the surface, a second downhole communications interface card 614 associated with one or more second downhole tools 615, and a cable core 613 connecting the surface and downhole interface cards. A two-core cable 621 includes the two cores 603, 613 and provides a communication media from the surface 620 down the well bore.

In an exemplary embodiment based on two downhole interface cards, each associated with a single tool, the diagnostic command priority can be selected to achieve a 15 minute update rate. In this exemplary embodiment, the command interval for the first card can be set to 5.000 seconds; the command interval for the second card can be set to 5.001 seconds. The command shift interval for the first card can be set to +1.053 seconds; the command interval shift for the second card can be set to −1.053 seconds. The downhole communications timeout can be selected to be 1 second. The diagnostic command priorities can be assigned the following prime numbers: 83, 89, 97, 101, 103, 107, 109, and 113.

Figure 7:
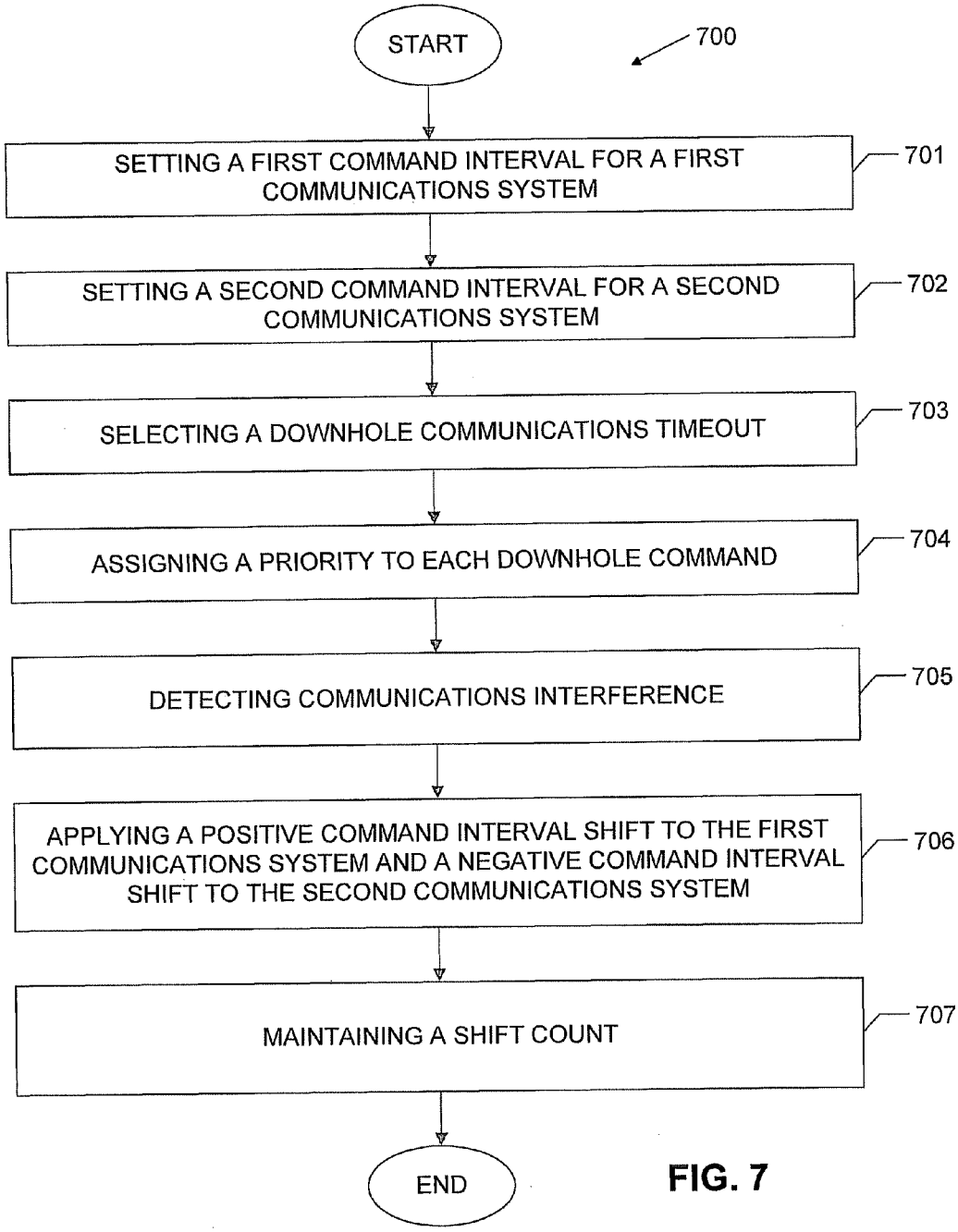
FIG. 7 is a flow diagram of a method of downhole time interlaced communications in accordance with an example embodiment of the present invention.

With reference now to FIG. 7, example embodiments can include a method 700 of downhole time interlaced communications. The method 700 can include setting a first delay value between consecutive downhole commands defining a first command interval for a first communications system associated with a cable and a first downhole tool shown at 701. The first command interval can be greater than an actual command duration to thereby define periods of communications inactivity to thereby allow communications with minimal interference for a second communications system associated with a second downhole tool. The method 700 can include setting a second delay value between consecutive downhole commands defining a second command interval for the second communications system associated with the cable and a second downhole tool shown at 702. The second command interval can be slightly greater than the first command interval to thereby overcome any effects of drift. The method 700 can include selecting a delay allowed for response data from the downhole tool defining a downhole communications timeout shown at 703. The downhole communications timeout can be of similar duration to the expected command response duration to thereby minimize any adverse system performance. The method 700 can include assigning a priority to each downhole command of a plurality of downhole commands shown at 704 to determine the frequency of execution. Also, each diagnostic command priority can be assigned a unique prime number so that a plurality of diagnostic commands is not executed at the same time. The method 700 can include detecting communications interference shown at 705. The method 700 can include applying temporarily a positive command interval shift to the first communications system and a negative command interval shift to the second communications system shown at 706 responsive to the detected communications interference so that a duration of a resynchronization is minimized. The method 700 can include maintaining for diagnostic purposes a count of a number of occurrences where communications interference has been detected defining a shift count shown at 707.

It is important to note that while the foregoing embodiments of the present invention have been described in the context of a fully functional system and process, those skilled in the art will appreciate that the mechanism of at least portions of the present invention and/or aspects thereof are capable of being distributed in the form of a computer readable medium storing a set of instructions in a variety of forms for execution on a processor, processors, or the like, and that various embodiments of the present invention apply equally regardless of the particular type of signal bearing media used to actually carry out the distribution. Examples of the computer readable media include, but are not limited to: volatile and a nonvolatile onboard memory, nonvolatile, hard-coded type media such as read only memories (ROMs), CD-ROMs, and DVD-ROMs, or erasable, electrically programmable read only memories (EEPROMs), recordable type media such as floppy disks, hard disk drives, CD-R/RWs, DVD-RAMs, DVD-R/RWs, DVD+R/RWs, HD-DVDs, memory sticks, mini disks, laser disks, Blu-ray disks, flash drives, and other newer types of memories, and certain types of transmission type media such as, for example, certain digital and analog communication links capable of storing the set of instructions. Such media can contain, for example, the processor executable portions of the method steps according to the various embodiments of a method of downhole time interlaced communications, described above.

While the invention has been shown or described in only some of its forms, it should be apparent to those skilled in the art that it is not so limited, but is susceptible to various changes without departing from the scope of the invention. For example, various components and/or designs can be utilized to implement the algorithms described herein or a variation of these algorithms. As such, those skilled in the art will appreciate that the operation and design of the present invention is not limited to this disclosure nor a specific embodiment discussed herein, but is susceptible to various changes without departing from the spirit and scope of the invention. In the drawings and specification, there have been disclosed illustrative embodiments of the invention and, although specific terms are employed, they are used in a generic and descriptive sense only and not for the purpose of limitation.

That claimed is:

1. A method of downhole time interlaced communications, the method comprising:

setting a first delay value between consecutive downhole commands defining a first command interval for a first communications system associated with a cable and a first downhole tool, the first command interval being greater than an actual command duration of each of the consecutive downhole commands to form periods of communications inactivity to thereby allow communications with minimal interference to a second communications system associated with a second downhole tool and having at least portions proximally located adjacent at least portions of the first communications system;

setting a second delay value between consecutive downhole commands defining a second command interval for the second communications system associated with the cable and a second downhole tool, the second command interval of the second communications system being slightly greater than the first command interval of the first communications system to thereby overcome any effects of drift;

detecting communications interference of at least one of the first or second communications systems with the other of the first or second communications systems;

applying temporarily a positive command interval shift to the first communications system and a negative command interval shift to the second communications system responsive to the detected communications interference to minimize resynchronization time.

2. A method of claim 1, further comprising:

maintaining for diagnostic purposes a count of a number of occurrences where communications interference has been detected defining a shift count.

3. A method of claim 1, further comprising:

selecting a delay allowed for response data from the downhole tool defining a downhole communications timeout, the downhole communications timeout being selected to have a similar duration to the expected command response duration to thereby minimize any adverse system performance.

4. A method of claim 1, further comprising:

assigning a priority to each downhole command of a plurality of downhole commands to determine the frequency of execution, wherein each diagnostic command priority is assigned a unique prime number so that each diagnostic command of a plurality of diagnostic commands is executed at a different time.

5. A method of claim 4, wherein the diagnostic command priorities of at least four of the plurality of diagnostic commands are assigned a value corresponding to at least four of the following: 83, 89, 97, 101, 103, 107, 109, and 113 representing a number of cycles of a task scheduler between execution of the respective diagnostic command.

6. A method of claim 1, wherein the first command interval is approximately 5 times the actual command duration.

7. A method of claim 1, wherein the first command interval, the second command interval, and the command interval shift are implemented using MODBUS registers;

wherein the cable is a two core downhole comprising a first core and a second core each positioned within the cable, the second core being adjacent the first core along at least a substantial portion of a length of the cable to cause signal interference therebetween;

wherein the first communications system provides consecutive downhole commands over the first core of the cable;

wherein the second communications system provides consecutive downhole commands over the second core of the cable; and wherein the step of detecting communications interference of at least one of the first or second communications systems with the other of the first or second communications systems includes detecting a collision between a downhole command sent over the first core of the cable and a downhole command sent over the second core of the cable coupled into the first core of the cable.

8. A system of downhole time interlaced communications, comprising:

a first communications system associated with a cable and a first downhole tool and configured with a first delay value between consecutive downhole commands defining a first command interval for the first communications system, the first command interval being greater than an actual command duration to thereby define periods of communications inactivity to thereby allow communications with minimal interference for a second communications system;

the second communications system associated with the cable and a second downhole tool and configured with a second delay value between consecutive downhole commands defining a second command interval for the second communications system, the second command interval being slightly greater than the first command interval to thereby overcome any effects of drift; and at least one interface card configured to perform a resynchronization of the first and second command intervals, including a positive correction to be applied to the first command interval defining a positive command interval shift and a negative correction to be applied to the second command interval defining a negative command interval shift responsive to a detected communications interference so that a duration of the resynchronization is minimized.

9. A system of claim 8, further comprising a shift count register configured to count of a number of occurrences where communications interference has been detected defining a shift count, wherein the shift count is maintained for diagnostic purposes.

10. A system of claim 8, wherein each of the first and the second communications systems is further configured to provide a delay allowed for response data from the downhole tool defining a downhole communications timeout, the downhole communications timeout being of similar duration to the expected command response duration to thereby minimize any adverse system performance.

11. A system of claim 8, wherein each of the first and the second communications systems is further configured with a plurality of priorities assigned to each of a plurality of downhole commands to determine the frequency of execution, wherein each diagnostic command priority is assigned a unique prime number so that a plurality diagnostic commands are not executed at the same time.

12. A system of claim 11, further comprising a task scheduler, and wherein the diagnostic command priorities of at least four of the plurality of diagnostic commands are assigned include a value corresponding at least four of the following: 83, 89, 97, 101, 103, 107, 109, and 113 representing a number of cycles of the task scheduler between execution of the respective diagnostic command.

13. A system of claim 8, wherein the first command interval is approximately 5 times the actual command duration.

14. A system of claim 8, wherein the first command interval, the second command interval, and the command interval shift are implemented using MODBUS registers.

15. An apparatus for downhole time interlaced communications, comprising:

a downhole configurable communications interface card configured to communicate with surface equipment having the following parameters:

a reset register configured to enable time interlaced communications, a command interval register configured to set the interval between the initiations of consecutive downhole commands to thereby define periods of communications inactivity to thereby allow communications with minimal interference for another communications system, a command interval shift register that is configured to apply a command interval shift temporarily when communications interference is detected, a shift count register configured to maintain a count of the number of occurrences where communications interference has been detected and the command interval shift has been applied, and a downhole communications timeout register configured to set a delay before a communications controller at the surface is put back into reset when no response from the downhole tool is received.

16. An apparatus of claim 15, wherein each of the parameters are implemented as MODBUS registers.

17. An apparatus of claim 15, wherein the command interval is approximately 5 times an actual command duration.

* * * * *